United States Patent [19]

Lejeune et al.

[11] Patent Number: 4,782,235

[45] Date of Patent: Nov. 1, 1988

[54] SOURCE OF IONS WITH AT LEAST TWO IONIZATION CHAMBERS, IN PARTICULAR FOR FORMING CHEMICALLY REACTIVE ION BEAMS

[75] Inventors: Claude Lejeune, Gif/Yvette; Jean P. Gilles, Pal ai Seau, both of France

[73] Assignee: Centre National de la Recherche Scientifique, Paris, France

[21] Appl. No.: 914,547

[22] Filed: Oct. 1, 1986

Related U.S. Application Data

[63] Continuation of Ser. No. 637,737, Aug. 6, 1984, abandoned.

[30] Foreign Application Priority Data

Aug. 12, 1983 [FR] France ..... 83 13298

[51] Int. Cl.[4] ..... H01J 27/02

[52] U.S. Cl. ..... 250/423 R; 315/111.81; 315/111.91; 376/127

[58] Field of Search ..... 204/298, 192.1; 250/423 R, 425; 315/111.81, 111.31, 111.41, 111.91; 376/127, 130

[56] References Cited

U.S. PATENT DOCUMENTS

| | | | |
|---|---|---|---|
| 3,408,283 | 10/1968 | Chopra et al. | 204/298 |
| 3,409,529 | 11/1968 | Chopra et al. | 204/192 |
| 3,472,751 | 10/1969 | King | 204/192 |
| 3,474,021 | 10/1969 | Davidse et al. | 204/192 E |
| 3,732,158 | 5/1973 | Przybyszewsky | 204/298 X |
| 3,767,551 | 10/1973 | Lang, Jr. et al. | 204/298 X |
| 3,838,031 | 9/1974 | Snaper | 204/298 X |
| 4,093,858 | 6/1978 | Kobayashi et al. | 250/425 X |
| 4,342,631 | 8/1982 | White et al. | 204/298 X |
| 4,377,773 | 3/1983 | Hershcovitch et al. | 250/423 R X |
| 4,521,719 | 6/1985 | Liebel | 250/423 R X |

FOREIGN PATENT DOCUMENTS

| | | | |
|---|---|---|---|
| 3134337 | 3/1983 | Fed. Rep. of Germany | 250/423 R |
| 2156978 | 3/1973 | France . | |
| 0004251 | 1/1983 | Japan | 250/423 R |
| 2088141 | 6/1982 | United Kingdom | 250/423 R |

OTHER PUBLICATIONS

Nishimura et al., "An Oxygen Ion Source for the Secondary Ion Mass Spectrometer", Mass Spectrometer, vol. 23, No. 1, 3/75, pp. 9–14.

*Primary Examiner*—John F. Niebling
*Assistant Examiner*—Nam X. Nguyen
*Attorney, Agent, or Firm*—Vorys, Sater, Seymour and Pease

[57] ABSTRACT

The ion source comprises a cathode, an intermediate electrode and an anode with two ionization chambers between these electrodes, means for producing an axial magnetic field, means for applying a DC voltage between an intermediate electrode and the anode, ion extraction means and an alternating voltage generator between the cathode and the intermediate electrode.

15 Claims, 3 Drawing Sheets

X-X
25
1
2
3a
4
4b
5
6
7
8
9
10a
11a
12a
13
14
15
16
17a
18
18a
19
19a
20
23
24
24a
28
29
30
30a
31
32
33
34
35
36
37
38
39
40
41
IV
V
VII

SOURCE OF IONS WITH AT LEAST TWO IONIZATION CHAMBERS, IN PARTICULAR FOR FORMING CHEMICALLY REACTIVE ION BEAMS

This application is a continuation of application Ser. No. 637,737, filed Aug. 6, 1984, now abandoned.

BACKGROUND OF THE INVENTION

The present invention relates to ion sources having at least two ionization chambers, in particular for forming chemically reactive beams of ions; it relates more particularly to ion sources of this type having a long life span.

Ion sources with two ionization chambers of the "duoplasmatron" and "duopigatron" type and ion sources having three ionization chambers of the "triplasmatron" type are, in particular known.

One ion source of the duoplasmatron type comprises a succession of a hot cathode, an intermediate electrode and an anode pierced with a discharge hole through which exits a plasma jet formed by the electrons and by the positive ions produced by this source. From the plasma jet the ion beam is formed by the action of a magnetic field. In the duoplasmatron, an arc is produced between the cathode and the anode, this arc being constricted in the vicinity of the discharge hole of the anode under the effect of an electrostatic action caused by the intermediate electrode and a magnetic lens action created between the anode and the intermediate electrode. The first ionization chamber between the cathode and the intermediate electrode is followed by the second chamber between the intermediate electrode and the anode.

The duopigatron is distinguished from the duoplasmatron by the fact that in the duopigatron a fourth electrode, disposed downstream of the anode, is brought, by means of an auxiliary voltage source, to a negative potential with respect to that of the anode thus forming an anti-cathode which is pierced with a discharge hole. The fourth electrode plays the role of second pole of the magnetic lens in place of the anode of the duoplasmatron.

Finally, the triplasmatron, which forms the subject matter of a French patent No. 2 156 978 filed on the Oct. 13, 1971 in the name of l'Agence Nationale de Valorisation de la Recherche, is formed by a duoplasmatron with, downstream of the discharge hole of the anode, a fourth electrode, called an expansion dish, which is maintained at a positive potential with respect to the anode. This fourth electrode preferably has the form of an enclosure, with an inlet aperture, forming the third ionization chamber which receives a jet of electrons and positive ions coming from the duoplasmatron and an outlet opening for forming an electron beam of positive ions and/or negative ions.

In these three known types of ion sources, the cathode is brought to a negative potential with respect to the intermediate anode by means of a DC generator. The DC potential difference thus created between the cathode and the intermediate electrode creates a field which serves for producing a plasma in the first chamber between these two electrodes.

Though such ion sources are used on the relatively large scale for different applications at the research stage, e.g., for implantation of ions, production of chemically reactive ion beams (formation of oxygenated, fluorinated and chlorinated compounds for example), technology of integrated circuits (oxidation of the semiconductors, etching of the integrated circuits by means of a reactive ion beam, and diagnosis of integrated circuits), they have however the disadvantage of a reduced life span incompatible with industrial development, particularly in the case of operation with gases reacting chemically with the hot thermoemissive cathode. This is because the partial reactive gas pressure in the vicinity of the hot cathode is high, even for the case of the triplasmatron which already represents an improvement in that the reactive gas is only introduced therein in the third chamber and under a pressure less by a factor of 20 to 100 than that existing in the first chamber whose typical value is $10^{-1}$ torr.

It was thought that the life span of ion sources having two or three chambers of the above mentioned type could be increased by using not a hot cathode, but a cold cathode for reducing the chemical reactions between some gases and the cathode, but the performances of the ion source are reduced, insofar as the ionization efficiency, the energy dispersion of the emitted ions, the emittance, the brightness and the reproducibility of the performances are concerned, when a cold cathode is used.

BRIEF SUMMARY OF THE INVENTION

The applicant has discovered with surprise that it is possible to considerably increase the life span of an ion source with at least two ionization chambers, particularly a duoplasmatron, a duopigatron and a triplasmatron, without sacrificing the performances thereof, by applying between the intermediate electrode and the cathode an alternating high frequency voltage for creating a stationary plasma in the first ionization chamber, while continuing to apply, in a known way, a DC voltage between the intermediate electrode and the other electrode of electrodes, so as to create a plasma in the following ionization chamber or chambers.

The invention has then as an object an ion source with at least two ionization chambers and at least three electrodes, namely successively a cathode, an intermediate electrode pierced centrally and a centrally pierced anode, the first ionization chamber being disposed between the cathode and the intermediate electrode and the second ionization chamber between the intermediate electrode and the anode, with means for producing an axial magnetic field between the intermediate electrode and the cathode, means for applying a DC voltage between the intermediate electrode and the electrode or electrodes other than the cathode and the intermediate electrode and ion discharge means, characterized in that it comprises a high frequency alternating voltage generator connected between the intermediate electrode and the cathode.

By using this high frequency alternating voltage between the intermediate electrode and the cathode, the same performances are obtained as with a hot cathode and a DC voltage between these electrodes, but with an appreciably increased life span.

With respect to ion sources having two or three ionization chambers comprising a cold cathode and a DC voltage, the performances are substantially improved while having a long life span.

Finally, compared with ion sources having a single ionization chamber (such as those according to a conventional technique) with high frequency energization, a source with at least two chambers is provided in accordance with the invention with a high frequency energized cathode, which presents appreciably superior performances especially insofar as the ionization efficiency of the gas, the energy dispersion of the ions, and the emittance of the beam are concerned.

The invention will, in any case, be well understood from the complement of description which follows as well as from the accompanying drawings, which complement and drawings are of course given especially by way of indication.

DESCRIPTION OF THE PREFERRED PARTICULAR EMBODIMENTS

According to the invention, and more especially according to that one of its modes of application and those of the embodiments of its different parts to which its seems preference should be given, desiring for example to construct an ion source with at least two ionization chambers, the following or similar is the way to achieve it.

Figure 1:
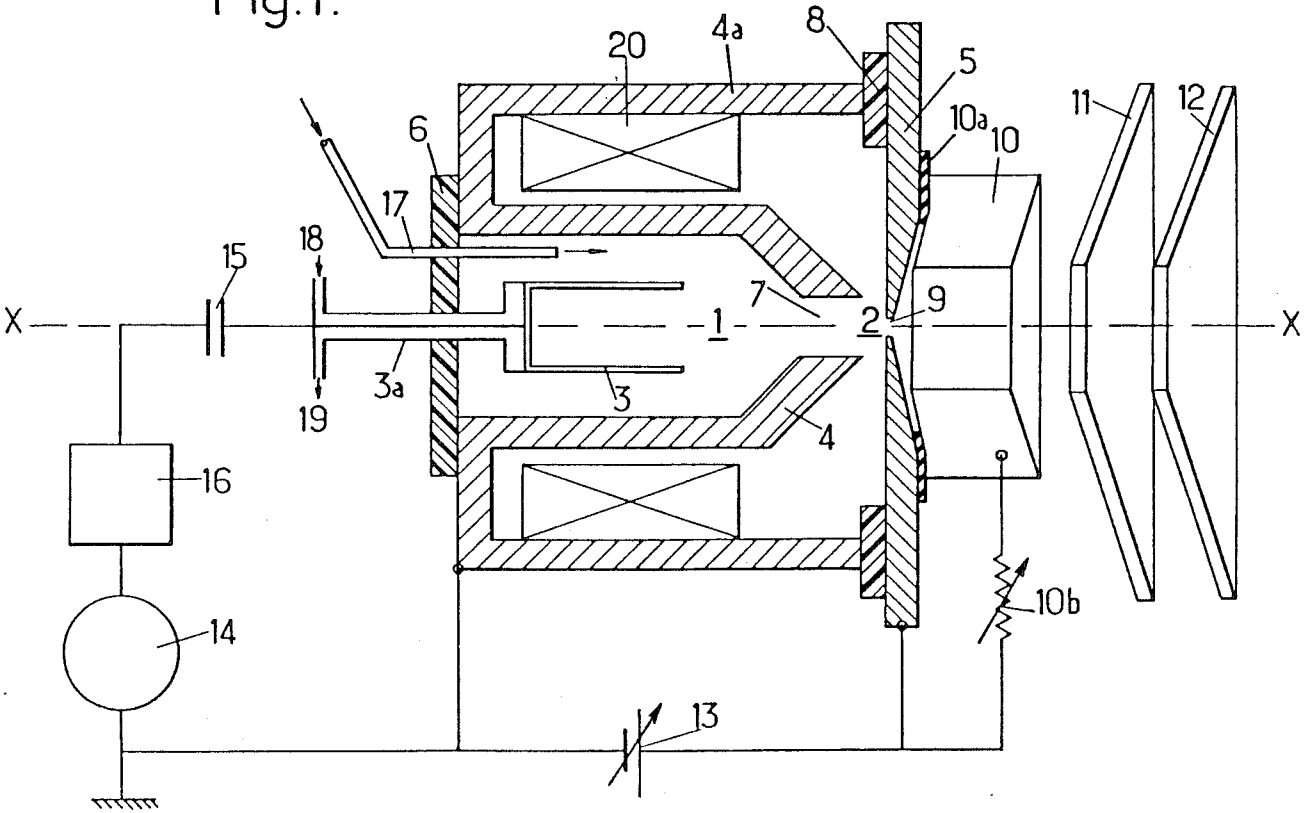
FIG. 1 represents, in longitudinal section, an ion source with two ionization chambers of the duoplasmatron type, provided with the improvements of the invention, with a first cathode embodiment.

Reference will be made first of all to FIG. 1 which illustrates the application of the invention to an ion source having two ionization chambers of the duoplasmatron type.

The two chambers are designated respectively by the reference numerals 1 and 2 and are disposed, the first one between a cathode 3 and an intermediate electrode 4, and the second one between the intermediate electrode 4 and an anode 5.

Reference will be made again to cathode 3 further whose end 3*a* passes through a block 6 of dielectric material supported by the intermediate electrode 4.

The electrode 4 is pierced, on the side opposite block 6, with a central aperture 7 through which the ions and the electrons formed in the first chamber 1 pass into the second chamber 2.

The anode 5, separated from the intermediate electrode 4 by an insulating ring 8, is also pierced at its center with an aperture 9 by which the electrons and the ions created by the ion source escape.

Downstream of the anode 5 is advantageously provided an annular expansion dish 10 separated from anode 5 by an electrically insulating and sealing ring 10*a*. The dish 10 is followed by an acceleration electrode 11 and a deceleration electrode 12, these latter two electrodes having advantageously the shape of a truncated cone.

The whole of the device which has just been described is cylindrical of revolution about an axis XX. By way of variant, a symmetrical arrangement may be provided with respect to a plane whose trace would then be XX.

The electrical supply comprises first of all, in a way known per se, a variable voltage source 13 which maintains the anode 5 at a positive potential, with respect to the intermediate electrode 4 and two high voltage sources (not shown), which maintain the acceleration 11 and deceleration 12 electrodes at negative potentials, with respect to the intermediate electrode 4. The high voltage applied to electrode 11 is more negative than that applied to the deceleration electrode 12.

The expansion disk 10 may be advantageously provided with an automatic biasing device formed simply by connecting it to the anode 5 through an adjustable resistance 10*b* whose value may be varied between 0 (which imparts to dish 10 the same potential as anode 5) and 1000Ω (which puts the dish 10 at a so called "floating" negative potential with respect to that of anode 5 and close to that of the intermediate electrode 4). This latter adjustment appreciably improves the performances of the ion source from the point of view of yield and brightness.

Finally, in accordance with the invention, a high frequency generator 14 is disposed between the intermediate electrode 4 and the cathode 3. In series with this high frequency generator is advantageously provide a blocking capacitor 15 removing any DC component in the supply of the cathode 3 and thus any transport of DC current between the cathode 3 and the electrodes 4 and 5 and thus ensuring automatic natural biasing of the cathode 3 with respect to the electrode 4, which promotes the formation of plasma in chambers 1 and 2. There may also be provided, in the supply circuit of cathode 3, an impedance matching circuit 16 for facilitating the power transfer from the generator 14 towards the discharge.

The supply of gas to be transformed into plasma (a mixture of electrons and of positive ions) in chambers 1 and 2 by the discharge produced between electrode 3 and anode 5 may be provided either through the cathode 3 which then has the form of a hollow cathode, or as shown in FIG. 1, by means of an intake duct 17 plunging into chamber 1 in the vicinity of electrode 3, which may also be a hollow electrode, as illustrated in FIG. 1, with a circular, square or rectangular, section for example. With such a hollow cathode, the collection area offered to the plasma formed in the first chamber 1 can be increased and so the self biasing potential difference of the cathode may be reduced, thus limiting heating thereof and erosion by spraying under the effect of the impact of the ions of the plasma.

The hollow cathode effect further causes a lowering of the minimum operating pressure of the whole of the discharge, thus improving the ionization yield of the gas injected through the duct 17 in the form of neutral particles and leaving partially ionized through the aperture 9 formed in the center of anode 5.

The hollow cathode 3 is cooled by a flow of fluid arriving at conduit 18 and leaving at conduit 19.

In a way known per se, the duoplasmatron operates under reduced pressure, for example from $5\times10^{-3}$ to $5\times10^{-1}$ Torr. A coil 20 is disposed about the intermediate electrode 4 so as to produce an axial inhomogenous magnetic field between the electrode 4 and the anode 5 which are made from a magnetic material, the return of the magnetic flux being ensured by a conventional magnetic circuit 4*a*.

Figure 2:
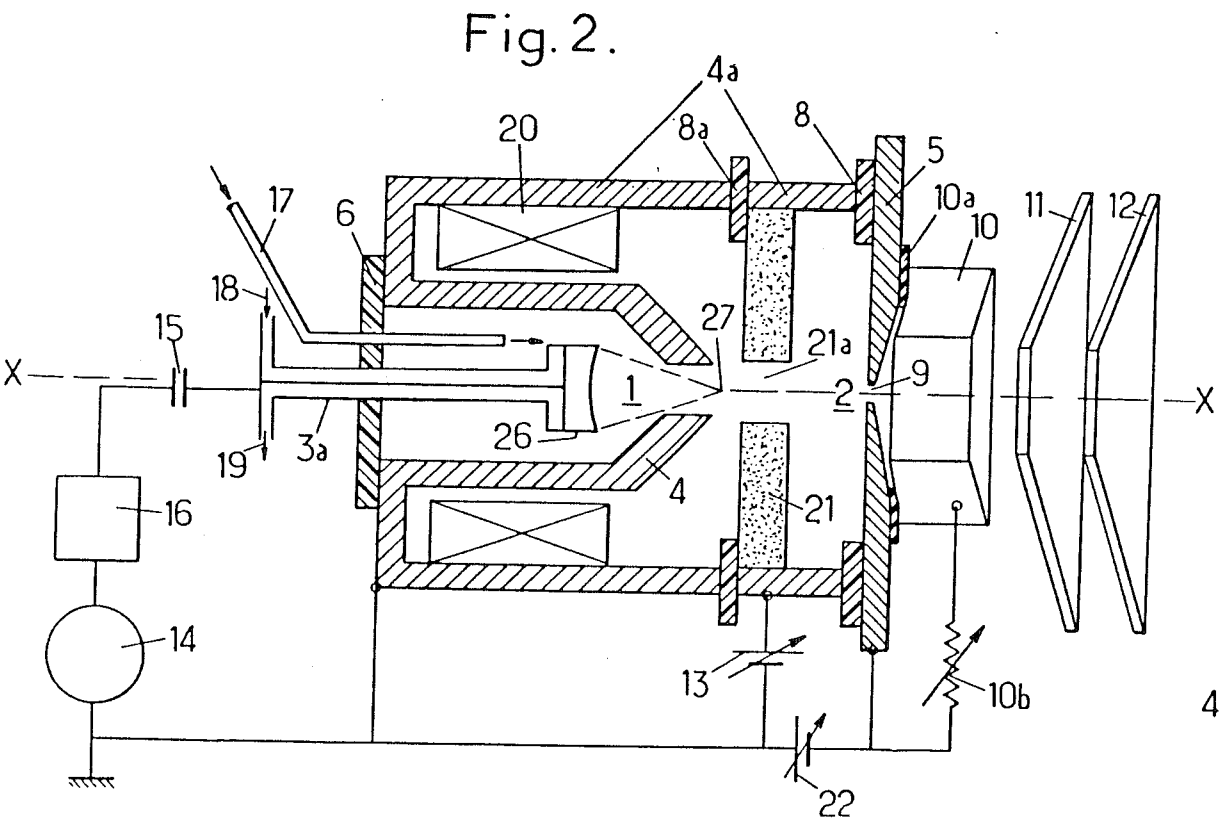
FIG. 2 shows, in longitudinal section, an ion source with two ionization chambers of the duopigatron type, provided with the improvements of the invention, with a second cathode embodiment.

In FIG. 2, another type of ion source with two ionization chambers is illustrated, namely of the duopigatron type, having the improvements of the invention. The same reference numbers are used for the embodiments shown in FIGS. 1 and 2 for designating corresponding elements and they will not be described again, except for a ring 8*a* completing the ring 8.

The differences between the duoplasmatron of FIG. 1 and the duopigatron of FIG. 2, both using a high frequency source 14 between the intermediate electrode and the cathode, concern (a) the modification of biasing the magnetic electrode 5 pierced with the orifice 9 for ejecting the plasma jet, which was the anode in the case of the duoplasmatron of FIG. 1, but forms, in the case of duopigatron of FIG. 2, an anti-cathode brought to a negative (or possibly zero) potential with respect to the intermediate electrode 4, by a DC source 22;

(b) the introduction, between the intermediate electrode 4 and the anti-cathode 5, both magnetic, of an anode 21 made from an amagnetic material, pierced along its axis with a wide channel 21*a* letting the discharge pass and polarized positively with respect to the intermediate electrode 4 by a DC voltage source 13; and (c) the cathode, which could be of the same type as that shown in FIG. 1, but which has been illustrated as being a sprayed cathode.

This spraying cathode 26 is cooled by a fluid arriving at conduit 18 and leaving at conduit 19, the gas to be ionized being introduced into chamber 1, as in the case of FIG. 1, by a duct 17.

A spraying cathode offers to the plasma formed in chamber 1 a small collection area compared with that offered by the intermediate electrode 4. The result is that the mean self-biasing voltage of such a cathode is very negative with respect to the potential of electrode 4, itself close to the potential of the plasma created in chamber 1. Because it is substantially proportional to the high frequency power injected, this self-biasing may reach 1000 V for a power of 200 W. Thus, the material of the cathode is sprayed under the impact of the ions accelerated by the self-biasing potential difference. This phenomenon may be used for introducing, in the discharge of the source, neutral atoms which will be ionized in turn then removed from the source. The cathode 26 in this case plays the role of a very efficient spraying electrode and the source with chambers 1 and 2 of FIG. 2 may deliver beams containing a significant fraction of ions associated with the material of the cathode, which is very advantageous for the case of substances with very low vapor voltage. It is true that this possibility of spraying the cathodes has already been contemplated for ion sources with cathode energized by a DC voltage, but in this case an auxiliary electrode is required, which complicates the construction and the operation. The yield of the operation for ionizing the neutrals ejected from the cathode and for extracting the ions formed is maximized if a concave surface is adopted for the cathode 26 whose center of curvature is situated on the axis of the source, in the median plane of the anode compartment or second ionization chamber 2, from which the ions are extracted, i.e. at 27 in FIG. 2. The source thus obtained is very suitable for injection in ion implanters, machines used industrially not only for the surface treatment of materials (for improving their corrosion resistance and mechanical strength qualities), but also for doping semiconductors (microelectronics).

Figure 4:
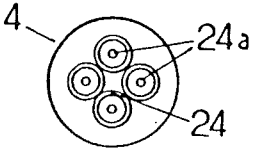
FIG. 4 is a section taken along line IV—IV of FIG. 3.
Figures 3, 5, 6, 7:
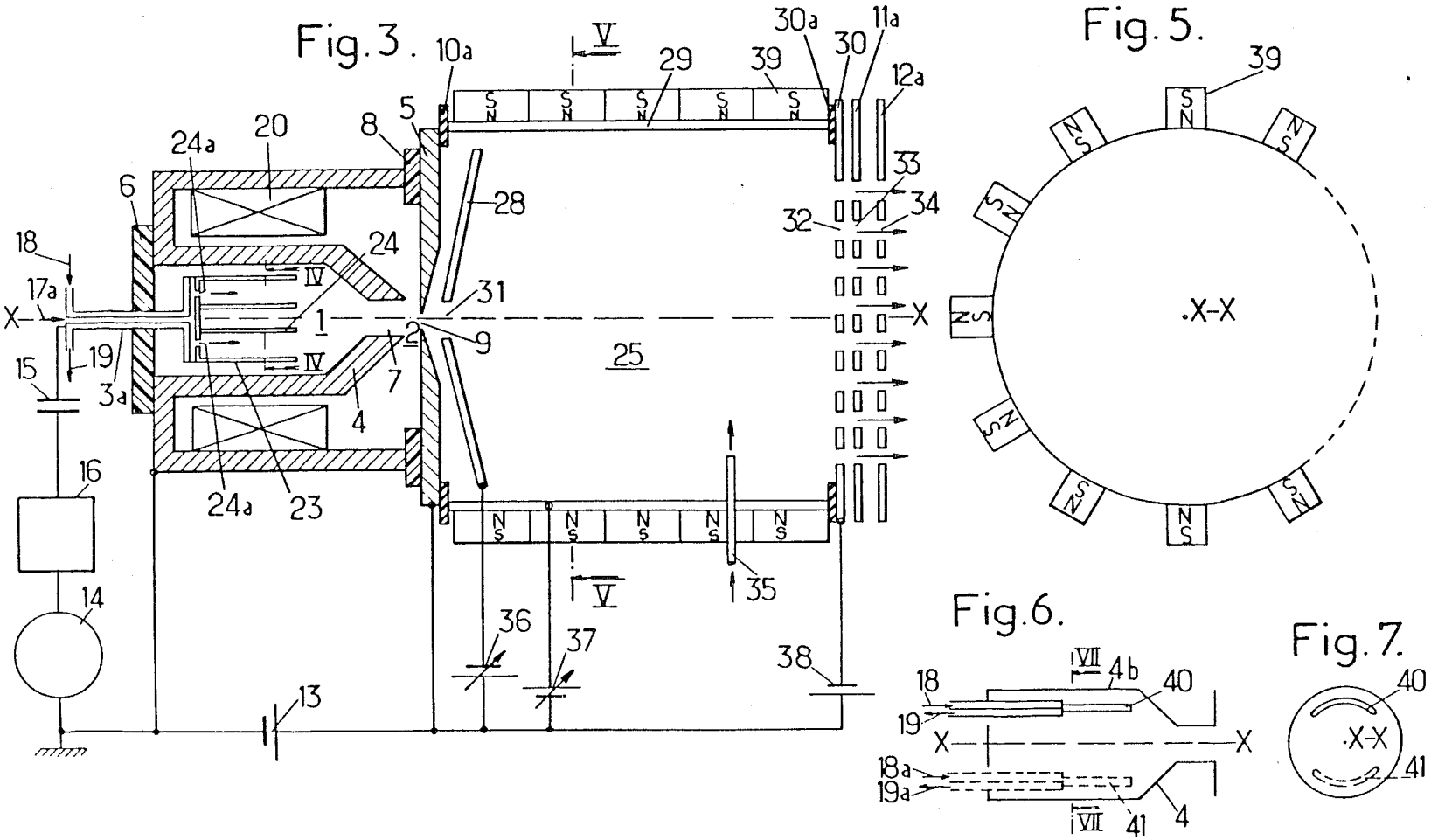
FIG. 3 shows, in longitudinal section, an ion source with three ionization chambers of the triplasmatron type, provided with the improvements of the invention, with a third cathode embodiment.
FIG. 5 is a section taken along line V—V of FIG. 3.
FIG. 6 illustrates another embodiment of a cathode for an ion source in accordance with the invention.
FIG. 7 is a section taken along line VII—VII of FIG. 6.

In FIGS. 3, 4 and 5 there is finally illustrated an ion source having three ionization chambers of the triplasmatron type, provided with the improvements of the invention.

In FIG. 3, the same reference numbers have been used as in FIGS. 1 and 2 for designating the corresponding elements which will not be described again.

The triplasmatron is distinguished from the ion sources of FIGS. 1 and 2 by the fact that it comprises not two ionization chambers, but three ionization chambers 1, 2 and 25.

Chambers 1 and 2 of FIG. 3 are similar to chambers 1 and 2 of FIG. 1, except for the structure of the cathode which could be of the same type as those illustrated in FIGS. 1 and 2, but which has been illustrated as comprising for example four tubes 24 which are cylindrical in section, as can be seen in section in FIG. 4. Of course, the section of the tubes could (particularly for an ion source with plane symmetry) be square in a variant. As in the case of FIG. 1, the cathode 23 is cooled by a flow of fluid arriving at conduit 18 and leaving at conduit 19; on the other hand, the gas to be ionized arrives at 17*a* and leaves from the cathode 23 through holes 24*a* for ionization in chamber 1.

In FIG. 1, a hollow cathode 3 has been illustrated having a single tube, with the intake of the gas to be ionized through a duct 17 separate from the cathode, whereas in FIG. 2 a spraying cathode 26 has been illustrated and, in FIG. 3, a cathode 23 is shown with four tubes, with intake of the gas to be ionized through this cathode. It is of course possible to provide, in each ion source of the duoplasmatron type (FIG. 1) or duopigatron type (FIG. 2) or even of the triplasmatron type (FIG. 3), a hollow cathode having one or more tubes, with round, square or rectangular sections for example, with the intake of the gas to be ionized either through the cathode, or at a distance from the cathode through a duct such as at the duct 17.

Downstream of anode 5, the structure of the triplasmatron of FIG. 3 is the following. A tertiary plasma generator is provided disposed downstream of the extraction hole 9 of anode 5 with electric and magnetic means for creating this plasma and confining it as stated in the above mentioned French Patent No. 2 156 978, these means comprising three electrodes, namely a reflector 28, an additional anode 29 and an anti cathode 30 followed (after a seal 30*a*) by acceleration 11*a* and deceleration 12*a* electrodes. The reflector 28 is pierced with a central orifice 31 for providing communication between the chamber 2 and the chamber 25 which may moreover receive a gas to be ionized through a duct 35, this gas being possibly the same as that introduced through duct 17*a* or different therefrom depending on requirements. The anti-cathode 30 and the electrodes 11*a* and 12*a* are each pierced with one or more aligned apertures 32, 33, 34 respectively, for the output of the plasma from the chamber 25 and for the subsequent formation of the ion beam.

The polarization of the electrodes 28, 29 and 30 is provided by DC voltage generators 36, 37 and 38 respectively, so that the electrons may be accelerated between anodes 5 and 29 and collected by the anode 29, but repelled by the electrodes 28 and 30 which in the aggregate connect a current of ions, while ensuring the axial electrostatic confinement of the ionizing electrons, whereas in the transverse directions the confinement of the electrons and of the ions is provided by magnetic means adapted for creating a surface induction field of the alternating magnetic multipole type either in line or at points, the magnetic induction being substantially zero in the central part of the chamber 25 at a few centimeters from the wall of the electrode 29 at the level of which this surface induction is created. The magnetic means illustrated in FIGS. 3 and 5 comprises a series of alternating NS magnetic poles, referenced by reference numeral 39. Other magnetic confinement means may of course be provided.

It can be seen that, in all the embodiments, cathode 3, 23, 26 are fed by a high frequency generator 14 in accordance with the fundamental characteristic of the invention. The blocking capacitor 15 avoids any transport of DC current between the cathode and the other electrodes while ensuring for the cathode a natural automatic biasing with respect to the intermediate electrode 4, which promotes the formation of the plasma in the different ionization chambers.

An intake may be further provided in one of the ion sources of FIGS. 1, 2 and 3 for the gas to be ionized in chamber 2, this gas being the same as that introduced in chamber 1 or different therefrom.

In each of the ion sources of FIGS. 1, 2 and 3, the cathode may be of any type, particularly of the type illustrated in FIGS. 1, 2 and 3–4 or the variants indicated above. It may also be of the type illustrated in FIGS. 6 and 7, described hereafter.

Insofar as the frequency of generator 14 is concerned, it must preferably be at least equal to the value of the lower limit frequency from which the plasma of the first chamber 1 is permanently ignited in a stationary balance condition independent of time. This lower limit frequency is in general of the order of 20 to 50 kHz.

The ion source may be either grounded, as illustrated in FIGS. 1, 2 and 3, the ion beam then being at a negative potential, at that of the electrode 12 or 12*a*, or connected to the positive high voltage, the ion beam then being at ground potential, as well as electrode 12 or 12*a*, and the ion source being decoupled from the high frequency generator 14 by isolating capacitors.

In FIGS. 6 and 7 is shown a cathode of the transverse electric field type adapted to be supplied with high frequency and to be disposed in an ion source with two or three ionization chambers of the type illustrated in FIGS. 1, 2 or 3, in the place of cathodes 3, 26 and 23, respectively.

In this embodiment, the cathode is formed by a capacitor plate 40 which may be either flat or concave, this latter form being illustrated more especially in FIG. 7. The plate 40 is advantageously cooled by a flow of a fluid arriving at conduit 18 and leaving at conduit 19; the other plate of the capacitor is formed by the lateral wall of the facing intermediate electrode 4, namely the wall 4*b*.

In this case, the high frequency field is transversal with respect to the axis XX of the source. If the high frequency supply device of the cathode plate 40 does not comprise the blocking capacitor 15 provided in the embodiments of FIGS. 1, 2 and 3, i.e. in the case of dynamic biasing of the cathode, a second plate 41 may be provided (shown with broken lines in FIGS. 6 and 7), plate 41 being identical to plate 40 and symmetrical therewith with respect to the axis XX, this additional plate 41 being provided for completing the symmetry. Plate 41 is connected electrically to the intermediate electrode 4 by a conductor not shown and, like plate 40 forming the cathode, it is cooled by the flow of a gas arriving at 18*a* and leaving at 19*a*.

The arrangement shown in FIGS. 6 and 7 allows a reactive ion beam to be formed and has the advantage of not occulting the axis XX by the discharge, contrary to cathodes 3, 26 and 23 of FIGS. 1, 2 and 3 respectively. Freeing axis XX from the discharge by the cathode, which allows if required devices of the ionic laser type to be formed, in which the light produced must be able to pass freely through the active medium along the axis of symmetry, may also apply to the use of ion sources with reactive gases fed into the first ionization chamber 1 either through the cathode, or at the side of the cathode.

As is evident and as it follows moreover already from what has gone before, the invention is in not limited to those of its modes of application and embodiments which have been more especially considered; it embraces, on the contrary, all variants thereof.

We claim:

1. An ion source having at least two ionization chambers and at least three electrodes, comprising successively along a longitudinal direction a cathode, an intermediate electrode with a first aperature at its center and an anode with a second aperature at its center, the first ionization chamber being disposed between said cathode and said intermediate electrode and the second ionization chamber being disposed between said intermediate electrode and said anode, comprising:

means for introducing an ionizable medium in said first ionization chamber in the vicinity of said cathode;

means for permanently applying, in operation, an A.C. voltage, at a frequency between about 20 and about 50 kHz, between said cathode and said intermediate electrode, thereby producing, in said first ionization chamber, a first plasma which remains ignited in a steady state;

means for applying, between said intermediate electrode and said anode, a D.C. voltage of a polarity such that said anode is maintained positive relative to said intermediate electrode, thereby extracting essentially electrons from said first ionization chamber into said second ionization chamber through said first aperature in said intermediate electrode, said electrons producing a second plasma in said second ionization chamber;

means for producing a longitudinal magnetic field between said intermediate electrode and said anode, thereby constricting said second plasma in said second ionization chamber; and means for extracting ions from said second ionization chamber through said second aperature in said anode.

2. The ion source according to claim 1, wherein the cathode is cooled by flow of a fluid.

3. The ion source according to claim 1, wherein the cathode is hollow and an intake of the gas to be ionized is provided through said cathode.

4. The ion source according to claim 1, which includes an intake duct for the gas to be ionized whose ejection end is located in the vicinity of the cathode.

5. The ion source according to claim 1, which is of the duoplasmatron type with two ionization chambers, the first one disposed between the cathode and the intermediate electrode and the second one between the intermediate electrode and the anode, this latter being pierced with an extraction hole through which the ions formed then leave said second chamber to be accelerated.

6. The ion source according to claim 1, which is of the duopigatron type with two ionization chambers, the first one disposed between the cathode and the intermediate electrode and the second one between the intermediate electrode and an anti cathode which is pierced with an aperture through which the ions formed then leave said second chamber to be accelerated, a non-magnetic anode being situated between these latter two electrodes and polarized positively with respect to the intermediate electrode, the anti cathode being polarized negatively with respect to the intermediate electrode.

7. The ion source according to claim 1, which is of the triplasmatron type with three ionization chambers, the first disposed between the cathode and the intermediate electrode, the second between the intermediate electrode and a first anode, which is the main anode, the third one being disposed between said main anode and a fourth electrode, which is a second anode, located downstream from said main anode, and means for maintaining said second anode at a positive potential with respect to said main anode, the fourth electrode being pierced with at least one aperture through which the ions formed then leave said third chamber to be accelerated.

8. The ion source according to claim 1, which is of the triplasmatron type with three ionization chambers, the first disposed between the cathode and the intermediate electrode, the second between the intermediate electrode and a first anode, which is the main anode, the third one being disposed between said main anode and a fourth electrode, which is a second anode, located downstream from said main anode, and that it comprises, in addition to the fourth electrode, a reflector and an anti-cathode negatively biased with respect to the main anode and magnetic means adapted to create a surface induction field in the vicinity of said second anode of the alternating multipole type so as to confine both the electrons and the ions in the third chamber, the ions being emitted through apertures pierced in the anti-cathode.

9. The ion source according to claim 1, wherein the cathode is formed by at least one tube.

10. The ion source according to claim 1, wherein cathode is a spraying cathode, the active surface of the spraying cathode being concave in shape and the center of curvature of the concavity being situated on the axis of the ions source in the median plane of the second ionization chamber.

11. The ion source according to claim 1, wherein the cathode forms one plate of a capacitor, the other capacitor plate being formed by the lateral wall of the intermediate electrode.

12. The ion source according to claim 1, which includes means for accelerating the ions formed and forming an extraction optical system.

13. An ion source according to claim 1, wherein said means for permanently applying, in operation, an A.C. voltage are constituted by an A.C. voltage generator and a capacitor, disposed in series between said cathode and said intermediate electrode.

14. An ion source as set forth in claim 13 further comprising an impedance circuit disposed in series with said generator and said capacitor between said cathode and said intermediate electrode.

15. An ion source having at least two ionization chambers and at least three electrodes, comprising successively along a longitudinal direction a cathode cooled by a flow of liquid, an intermediate electrode with a first aperature at its center and an anode with a second aperture at its center, the first ionization chamber being disposed between said cathode and said intermediate electrode and the second ionization chamber being deposed between said intermediate electrode and said anode, comprising:

means for introducing an ionizable medium in said first ionization chamber in the vicinity of said cathode;

means for permanently applying, in operation, an A.C. voltage, at a frequency between about 20 and about 50 kHz, between said cathode and said intermediate electrode, thereby producing, in said first ionization chamber, a first plasma which remains ignited in a steady state;

said means for permanently applying an A.C. voltage including an A.C. voltage generator and a capacitor disposed in series between said cathode and said intermediate electrode;

means for applying, between said intermediate electrode and said anode, a D.C. voltage of a polarity such that said anode is maintained positive relative to said intermediate electrode, thereby extracting essentially electrons from said first ionization chamber into said second ionization chamber through said first aperature in said intermediate electrode, said electrons producing a second plasma in said second ionization chamber;

means for producing a longitudinal magnetic field between said intermediate electrode and said anode, thereby constricting said second plasma in said second ionization chamber; and means for extracting ions from said second ionization chamber through said second aperature in said anode.

* * * * *